US005426828A

United States Patent [19]

Kusano

[11] Patent Number: 5,426,828

[45] Date of Patent: Jun. 27, 1995

[54] SEPARABLE BUTTON ASSEMBLY FOR REMOVABLE CONNECTION TO A CLOTH ARTICLE OR THE LIKE

[76] Inventor: Yukio Kusano, 10-5, Sanjo-machi, Aoba-ku, Sendai-shi, Miyagi-ken, Japan

[21] Appl. No.: 114,328

[22] Filed: Aug. 30, 1993

[30] Foreign Application Priority Data

Oct. 13, 1992 [JP] Japan ..... 4-274374

[51] Int. Cl.[6] ..... A44B 1/00

[52] U.S. Cl. ..... 24/105; 24/114.7; 24/103; 24/111

[58] Field of Search ..... 24/105, 104, 103, 111, 24/90 A, 90 R, 90 TA

[56] References Cited

U.S. PATENT DOCUMENTS

| | | | |
|---|---|---|---|
| 27,114 | 2/1860 | Masure | 24/105 |
| 272,968 | 2/1883 | McKevit | 24/105 |
| 439,139 | 10/1890 | Gaynor | 24/90 A |
| 1,176,619 | 3/1916 | Sykes | 24/105 |
| 1,283,111 | 10/1918 | Doran | 24/105 |
| 1,776,096 | 9/1930 | Alland | 24/105 |
| 1,793,712 | 2/1931 | Morehouse | 24/105 |
| 2,584,828 | 2/1952 | Ballou, Jr. | 24/105 |
| 3,583,039 | 6/1971 | Walker | 24/105 |
| 4,953,268 | 9/1990 | Chang | 24/105 |
| 5,010,625 | 4/1991 | Joyer | 24/105 |

FOREIGN PATENT DOCUMENTS

| | | | |
|---|---|---|---|
| 2289136 | 7/1976 | France | 24/105 |

*Primary Examiner*—Victor N. Sakran

*Attorney, Agent, or Firm*—Brooks Haidt Haffner & Delahunty

[57] ABSTRACT

Disclosed is a button which includes: a pin screw having a needle section, a button head on which the pin screw is provided, and a nut threadedly engaged with the pin screw, where the pin screw and the nut, provided directly or indirectly on the button head, are formed to be detachable with respect to each other, so that the button head can be fastened to clothes or the like solely by piercing the pin screw therethrough and engaging the nut with the pin screw, thereby making it possible to easily attach or detach the button to or from an arbitrary position on clothes or the like.

4 Claims, 3 Drawing Sheets

SEPARABLE BUTTON ASSEMBLY FOR REMOVABLE CONNECTION TO A CLOTH ARTICLE OR THE LIKE

BACKGROUND OF THE INVENTION

1. Field of the Invention

This invention relates to a button and, in particular, to a novel, improved button which can be attached and detached by means of a pin screw and a nut instead of thread.

2. Description of the Related Art

FIG. 1 shows a conventional button for clothes, etc. As shown in the drawing, a conventional button 5 is generally attached to clothes 4 by means of a thread 3 passed through a thread-passing section 2 provided on a button head 1.

A conventional plate-shaped button (not shown) for shirts or the like is attached to clothes by means of a thread passed through holes formed in the button, formed as an integral piece. The above-described conventional button 5 is also formed as an integral piece, with the thread-passing section 2 firmly fixed to the button head 1.

Conventional buttons for clothes, etc., constructed as described above, have the following problems:

Conventional buttons for clothes are all sewn onto clothes by means of thread, with the result that the making of clothes requires a difficult sewing operation, which is very hard to mechanize.

In the case of a fashionable gilt button, its surface layer may be rubbed off, resulting in discoloration or exfoliation. In such cases, all the buttons on the same clothing will have to be replaced. A set of buttons for European clothes are rather expensive. Thus, such a replacement is a waste of material.

Further, buttons have no quality indication on them, which leads to a problem when clothes with buttons are sent to the laundry. Various means may be used to prevent them from coming off or being damaged during cleaning. For example, fashionable buttons are wrapped in aluminum foils so as to prevent them from being damaged. Despite this precaution, damage often occurs, the laundry being obliged to compensate for such loss or damage.

Another problem with conventional buttons is that they are attached to clothes, shirts, etc. by means of thread. To meet customers' requirements, many different sizes of clothes and shirts, onto which buttons have been sewn, have to be prepared, resulting in enormous stocks of clothes.

SUMMARY OF THE INVENTION

The present invention has been made with a view toward solving the above problems. It is an object of the present invention to provide a button which can be attached or detached by means of a pin screw and a nut instead of thread.

In accordance with the present invention, there is provided a button comprising: a pin screw having a needle portion, a button head on which the pin screw is provided, and a nut threadedly engaged with the pin screw.

More specifically, the button head can be directly attached to and detached from the pin screw.

More specifically, the button head can be attached to and detached from a flange provided on the pin screw.

More specifically, the above-mentioned flange is provided with an outside screw thread.

More specifically, the above-mentioned button head has a fragrance emitting section.

More specifically, the button head is formed to constitute a bell.

More specifically, the button head has a light emitting section.

More specifically, a plurality of pin screws and nuts as mentioned above are provided in a button.

In the button of the present invention, the pin screw and the nut, provided directly or indirectly on the button head, are formed to be detachable with respect to each other, so that the button head can be fastened to clothes, shirts, tents, automobile covers, sheets, fasteners, etc. solely by piercing the pin screw through the clothes or the like and engaging the nut with the pin screw, thereby making it possible to easily attach or detach the button to or from an arbitrary position on the clothes or the like. Accordingly, it is possible to arbitrarily change the size of clothes, sheets, tents, etc.

Accordingly, the button head can be easily replaced, thus facilitating replacement in the case of discoloration or damage. Further, by forming the button head as a fragrance emitting section, a bell, or a light emitting section, variegated functions can be realized.

DESCRIPTION OF THE PREFERRED EMBODIMENTS

Figure 1:
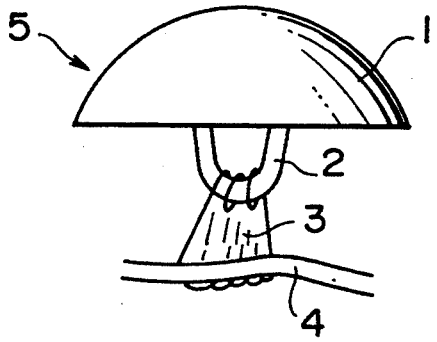
FIG. 1 PRIOR ART
FIG. 1 shows the construction of a conventional button for clothes.

Preferred embodiments of the present invention will now be described in detail with reference to the accompanying drawings.

In the drawings, the components which are the same as or equivalent to those of the conventional example will be indicated by the same reference numerals.

First Embodiment

Figure 2:
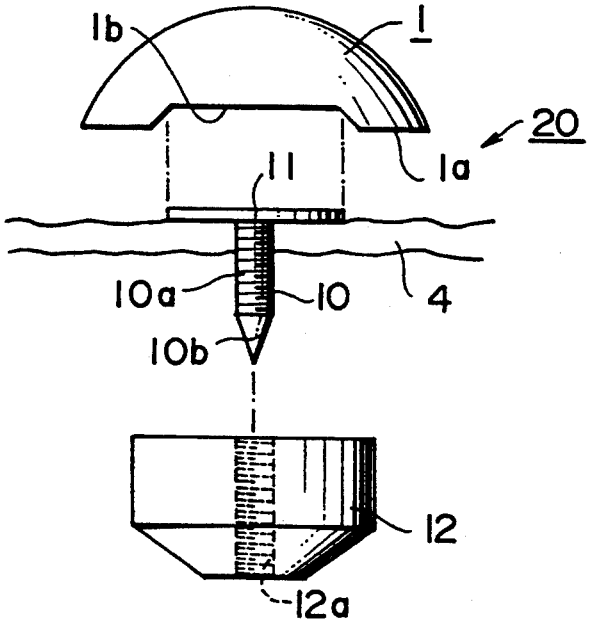
FIG. 2 is an exploded view of a button according to an embodiment of the present invention.

FIG. 2 shows a button 20 according to a first embodiment of this invention. In the drawing, numeral 1 indicates a button head having an inner void section and formed as an integral piece by caulking or the like. The button head 1 has a recess **1*b* formed on a bottom section 1*a* thereof. A flange 11 having a pin screw 10 integrally formed therewith is joined to the recess 1*b* to form an integral unit (In FIG. 2**, which is an exploded view, they are shown in a separated state).

The pin screw 10 includes a screw thread section **10*a* and a needle section 10*b*, which are integrally formed. The pin screw 10 is threadedly engaged with a nut 12 through a thread screw hole 12*a*** thereof.

Thus, when producing the above-described button 20, constructed as shown in FIG. 2, the flange 11 is integrally joined to the button head 1 by a joining means such as soldering, adhesion or brazing, and then the nut 12 is threadedly engaged with the pin screw 10, thereby completing the button.

When attaching the button 20, for example, to an article of clothing 4, the pin screw 10 pierces through the clothing 4, and then the nut 12 is threadedly engaged with the portion of the screw thread section 10*a* protruding from the clothing 4, thereby completing the attachment.

The clearance between the button head 1 and the clothing 4 can be set by arbitrarily changing the diameter and thickness of the flange 11.

Second Embodiment

Figure 3:
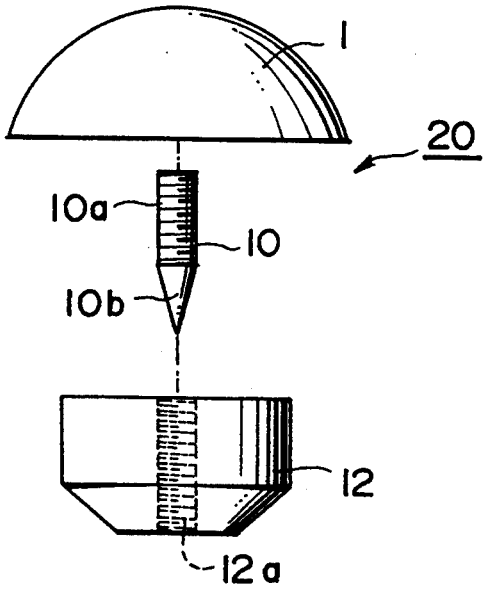
FIG. 3 is an exploded view of a button according to another embodiment of the present invention.

FIG. 3 shows a second embodiment of this invention, according to which the pin screw 10 is directly joined to the button head 1 without using the flange 11. Thus, the pin screw 10 and the button head 1 can be joined together irrespective of whether the flange 11 is provided or not.

Third Embodiment

Figure 4:
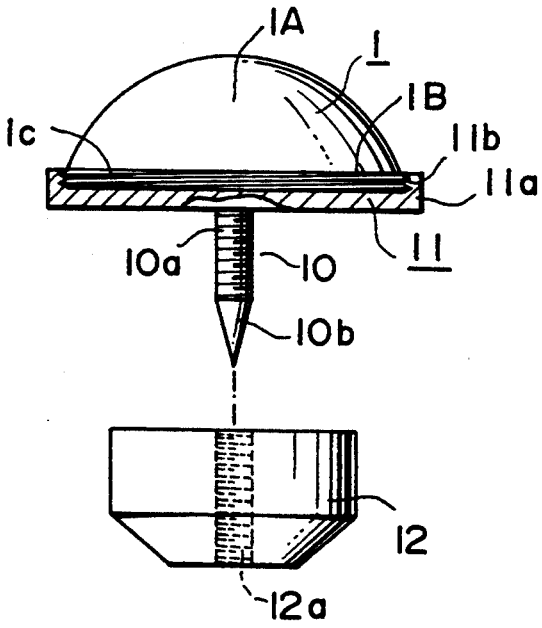
FIG. 4 is an exploded view of a button according to still another embodiment of the present invention.

FIG. 4 shows a third embodiment of this invention, according to which a raised section 11*a* is formed in the outer periphery of the flange 11. The raised section 11*a* has an inside screw thread 11*b*, which is detachably engaged with a screw thread section 1*c* of a button carrier 1B for carrying a button decorating section 1A. The button decorating section 1A, which is thus detachable with respect to the flange 11, can be freely replaced.

Fourth Embodiment

Figure 5:
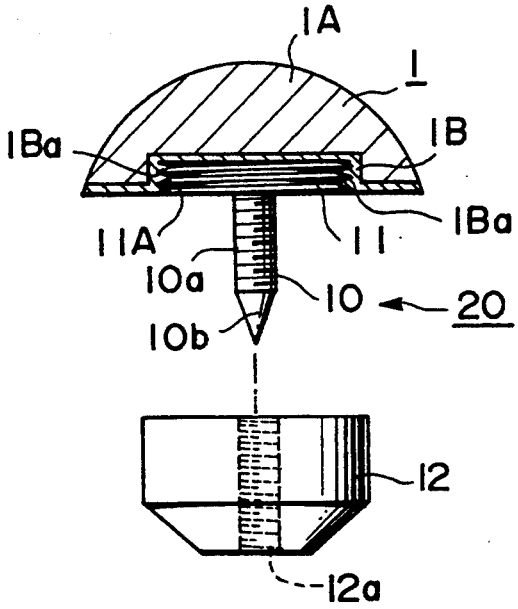
FIG. 5 is an exploded view of a button according to a still further embodiment of the present invention.

FIG. 5 shows a fourth embodiment of this invention, according to which the button head 1 is composed of the button decorating section 1A and the button carrier 1B, which has a screw thread section 1B*a*. The flange 11 has an outside screw thread section 11A, which is threadedly engaged with the screw section 1B*a*. Thus, the button decorating section 1A is detachable with respect to the flange 11, that is, freely replaceable.

Fifth Embodiment

Figure 6:
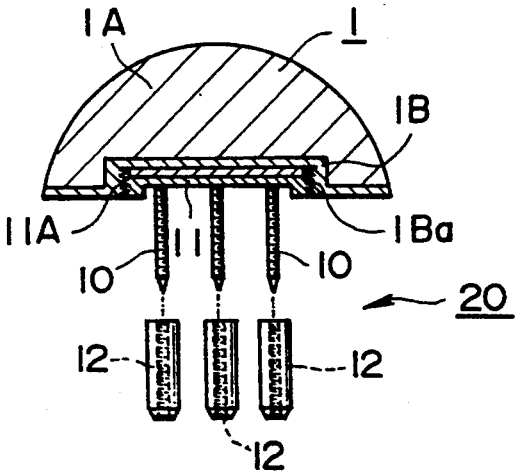
FIG. 6 is an exploded view of a button according to a still further embodiment of the present invention.

FIG. 6 shows a fifth embodiment of this invention, according to which a plurality of pin screws 10 and a plurality of nuts 12 are provided in a single button. The diameter of each pin screw 10 is smaller than that in the above embodiments, so that the through-holes made in the clothing 4 when the pin screws 10 of the flange 11 pierce therethrough for attachment, can be smaller.

The above-described embodiments are given only as typical examples of the button construction of this invention. It goes without saying that the scope of the present invention covers any construction in which the button head 1 and the pin screw 10 are joined together and the nut 12 is engaged with the pin screw 10 for attachment of the button. Further, although not shown in the drawings, the button head 1 may contain, for example, a fragrance emitting section to emit fragrance, an aluminum ball to form a bell, or an LED to form a light emitting section.

Further, although the above embodiments are described as applied to clothing, the button of this invention can be used for other purposes. For example, it can be used for connection and size adjustment of tents, automobile covers, fasteners, etc.

The button of the present invention, constructed as described above, provides the following advantages:

It can be attached and detached to and from clothes without using thread, thereby remarkably facilitating the attachment of buttons.

Further, since the buttons can be easily attached and detached, the clothing to which it is attached can be sent to the laundry for cleaning after removing the buttons, thereby totally eliminating the damage, etc. of the buttons during cleaning.

In addition, since the button decorating section can be separately attached and detached, it can be easily and economically replaced with a new one when its surface has deteriorated with time.

The fact that the button can be easily attached and detached leads to another advantage. That is, since buttons can be attached to clothes in accordance with customers' requirements, there is no need to have large stocks of various kinds of clothes, shirts, etc., thereby contributing to a substantial reduction in stocks.

Also, though not shown in the embodiments, the above fact leads to still another advantage: a substantial reduction in stocks can also be achieved when these buttons are applied, for example, to clothes for both males and females, clothes with adjustable sleeves, or clothes having flaps in the collar and/or the waist.

Further, by using these buttons, it is possible to perform joint connection and size adjustment for articles other than clothes, such as tents, sheets, automobile covers, and fasteners.

What claimed is:

1. A separable button assembly for removable connection to a cloth article or the like, comprising:
   - a thin button carrier element having an upperside surface, an underside surface, and a circular screw thread extending perpendicular to its said upperside and underside surfaces;
   - a button head secured to said upperside surface of said button carrier element;
   - a thin flange element having an upperside surface, an underside surface and a circular screw thread extending perpendicularly to said upperside and underside surfaces for threaded connection to said screw thread on the button carrier element;
   - at least one pin secured to and projecting perpendicularly from said underside surface of the flange element, each said pin having a sharpened outer end for piercing the cloth of said cloth article; and
   - a nut having means for separable mounting on each said pin at a location therealong.

2. A separable button assembly according to claim 1, wherein said button carrier element has circular shape and its said circular screw thread is a male thread disposed around the periphery thereof; said flange element has circular shape which is larger in diameter than said circular shape of the button carrier element and further has a raised peripheral flange portion projecting perpendicularly outward from its said upperside surface to provide an inwardly facing annular edge thereon; and said circular screw thread on said flange element is a female thread disposed around said inwardly facing annular edge on said peripheral flange portion.

3. A separable button assembly according to claim 1, wherein said button carrier element has a centrally recessed circular portion in its said underside surface providing an inwardly facing annular edge thereon, and said circular screw thread of the button carrier element is a female thread disposed around said inwardly facing annular edge; said flange element has circular shape, and said circular screw thread of the flange element is a male thread disposed around the periphery of said circular flange element.

4. A separable button assembly according to claim 3, wherein a plurality of laterally spaced apart pins are each secured to and project perpendicularly from said underside surface of the flange element.

* * * * *